US007014807B2

(12) United States Patent
O'Brien

(10) Patent No.: US 7,014,807 B2
(45) Date of Patent: Mar. 21, 2006

(54) PROCESS OF MAKING POLYPEPTIDE FIBERS

(75) Inventor: John P. O'Brien, Oxford, PA (US)

(73) Assignee: E.I. duPont de Nemours and Company, Wilmington, DE (US)

( * ) Notice: Subject to any disclaimer, the term of this patent is extended or adjusted under 35 U.S.C. 154(b) by 373 days.

(21) Appl. No.: 10/340,609

(22) Filed: Jan. 9, 2003

(65) Prior Publication Data

US 2003/0155670 A1 Aug. 21, 2003

Related U.S. Application Data

(60) Provisional application No. 60/347,262, filed on Jan. 9, 2002.

(51) Int. Cl.
*D01D 5/06* (2006.01)
*D01D 5/16* (2006.01)
*D01F 4/00* (2006.01)

(52) U.S. Cl. ..... 264/202; 264/211.12; 264/234

(58) Field of Classification Search ..... 264/28, 264/202, 211.12, 234
See application file for complete search history.

(56) References Cited

U.S. PATENT DOCUMENTS 5,171,505 A * 12/1992 Lock ..... 264/202
5,252,277 A * 10/1993 Uy ..... 264/202 X
5,252,285 A 10/1993 Lock
2004/0097709 A1 * 5/2004 Armato et al. ..... 530/353

OTHER PUBLICATIONS

S. S. Raje, Rekha V. D. and M. R. Mathur, Regeneration of Silk fibroin from Silk waste and its applications, Man-made Textiles in India (Apr. 1998), pp. 160-167.
C. Earland and D. J. Raven, Nature (4427, Sep. 4, 1954) p. 461.
Steven Arcidiacono, Charlene M. Mello, Michelle Butler, Elizabeth Welsh, Jason W. Soares, Alfred Allen, David Ziegler, Thomas Laue and Susan Chase, Aqueous Processing and Fiber Spinning of Recombinant Spider Silks, Macromolecules, 35 (4), 1262-1266, 2002.

* cited by examiner

*Primary Examiner*—Leo B. Tentoni
(74) *Attorney, Agent, or Firm*—Gerald E. Deitch

(57) ABSTRACT

Process of making polypeptide fibers including the steps of contacting a polypeptide with a solution of formic acid a divalent metal ion salt, or contacting a decrystallized polypeptide with formic acid having a water content less than 3 wt % and concentrating the resulting solution to a polypeptide concentration greater than 10 wt %.

6 Claims, 2 Drawing Sheets

PROCESS OF MAKING POLYPEPTIDE FIBERS

FIELD OF THE INVENTION

This invention relates to the preparation of polypeptide fibers, especially regenerated silk fibers having mechanical properties well suited for textile and apparel applications and the spinning processes that underlie their preparation.

BACKGROUND OF THE INVENTION

It is well known that the mechanical properties of synthetic organic fibers are strongly dependent upon the chain length of the molecules comprising them and their degree of orientation with respect to the fiber axis. If the molecular chain length falls below a certain level (which varies according to the type of material), the resulting chain ends and small molecules act as defects that substantially limit fiber tensile strength. It is therefore preferred in synthetic fiber production to extrude fibers from solutions or melts in which the number of low molecular weight molecules has been reduced as much as possible and that have the highest average chain length consistent with processibility. In general when the inherent viscosity of silk fibroin falls below a value of about 0.8 dL/g, the molecular weight has been reduced to the extent that low strength, brittle fibers are obtained on extrusion. The mechanical properties of a variety of silks and other fibers can be found in Kirk-Othmer Encyclopedia of Chemical Technology, $4^{th}$ edition, volume 22, pages 160–161, herein incorporated by reference. Hence, the identification of new solvents that do not reduce the molecular weight of silk fibroin on a time scale that is useful for commercial production processes is of great utility for regenerated silk fiber production. The current invention enables preparation of fibers having useful tensile properties.

S. S. Raje, Rekha V. D and M. R. Mathur, Man-Made Textiles in India (April 1998), pp. 160–167, discloses the use of formic acid/water solutions with $CaCl_2$ as a solvent for raw silk. Significant molecular weight loss of the silk fibroin is demonstrated by intrinsic viscosity reductions. C. Earland and D. J. Raven, *Nature* (4427, Sep. 4, 1954) p. 461, discloses the dissolution of silk in a solution of $CaCl_2$ in formic acid containing 2% water. Significant reductions in intrinsic viscosity are noted in this article as well.

U.S. Pat. No. 5,252,285 discloses a process for spinning silk fibers after first dissolving silk fibroin in an aqueous salt solution, removing the salt from the solution, removing water to form the regenerated silk material, and then dissolving the silk material in hexafluoroisopropanol to form a fiber-spinnable solution. The two-step procedure is necessary because the aqueous silk solution is not useful for fiber spinning because of its high sensitivity to shear stress causing it to rapidly precipitate and block the spinneret capillaries during extrusion. As a consequence, the silk fibroin must be isolated from aqueous solution and redissolved in solvents such as hexafluoroisopropanol or mixtures of formic acid with lithium salts so that extrusion can be carried out without shear induced precipitation.

Although hexafluoroisopropanol provides regenerated silk fibers with excellent mechanical properties it is not an attractive spinning solvent because of its high toxicity and cost. Likewise, although mixtures of formic acid with lithium salts provide shear stable spinning solutions the as-spun fiber mechanical properties obtained are not useful for textile and apparel applications and require further downstream processing to develop useful mechanical properties.

SUMMARY OF THE INVENTION

Disclosed herein is a process for producing polypeptide fibers, the process comprising the steps of:

(a) providing a polypeptide,
(b) contacting the polypeptide with a solution of formic acid and a divalent metal ion salt,
(c) metering the solution produced in step (b) through a spinneret into liquid contained in at least one coagulation bath to form one or more fibers,
(d) drawing the fibers, and
(e) optionally, winding the fibers on a receiving station.

Also disclosed is a process for producing regenerated polypeptide fibers, the process comprising the steps of:

(a) providing a decrystallized polypeptide,
(b) contacting the decrystallized polypeptide with formic acid containing no more than 3 weight percent water, initially at less than 10 percent polypeptide by weight,
(c) concentrating the solution produced in step (b) to greater than 10 percent polypeptide by weight,
(d) metering the concentrated solution produced step (c) through a spinneret into a liquid contained in a coagulation bath to form one or more fibers,
(e) drawing the fibers, and
(f) optionally, winding the fibers onto a receiving station.

Further disclosed is a process for producing polypeptide fibers, the process comprising the steps of:

(a) providing a polypeptide,
(b) contacting the polypeptide with water/lithium thiocyanate initially at less than 15 percent polypeptide by weight,
(c) concentrating the solution produced in step (b) to greater than 15 percent polypeptide by weight,
(d) metering the concentrated solution produced in step (c) through a spinneret into a liquid contained in a coagulation bath to form one or more fibers,
(e) drawing the fibers, and
(f) optionally, winding the fibers onto a receiving station.

More particularly, the process disclosed as above relate to polypeptide fibers that are natural silk or synthetic silk proteins.

DETAILED DESCRIPTION OF THE INVENTION

This invention relates to the preparation of regenerated silk fibers having mechanical properties well suited for textile and apparel applications and the spinning processes that underlie their preparation. In particular, the invention describes non-degrading spinning solvents for silk fibroin and related proteins that offer high solids processing and excellent spinnability for conversion into continuous multifilament yarns having fiber diameters, cross sections and filament lengths that are not accessible in natural silk fibers. The spun fibers have a predominantly beta sheet structure in the ordered regions which is similar to that of natural

Figure 2:
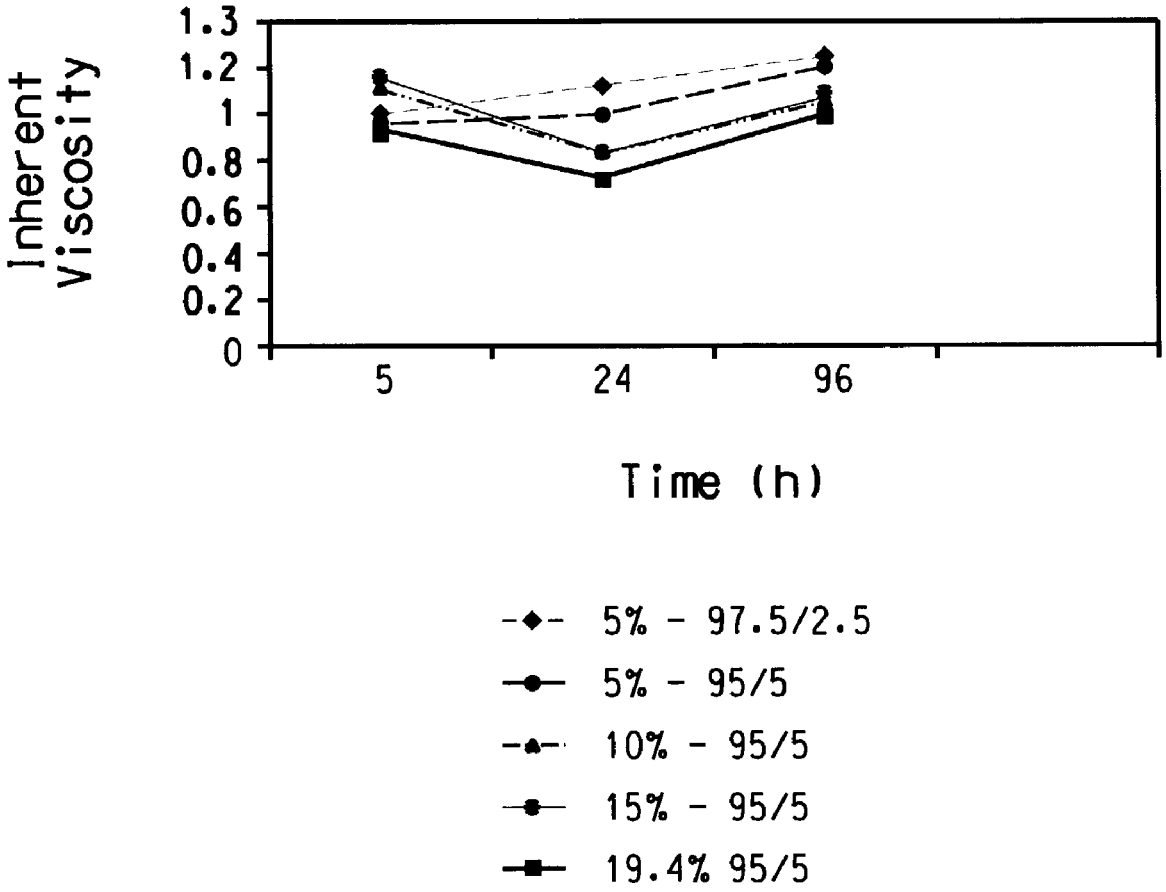
FIG. 2 is a graph of the molecular weight stability of *Bombyx mori* silk in $HCOOCH/CaCl_2$.

*Bombyx mori* silk fibers. The orientation and extent of the beta sheet structure is dependent both upon the concentration of the silk protein in the spinning solution and the fiber spinning process. One particularly notable feature of this invention is the discovery that mixtures of low water content formic acid and divalent metal ion salts such as $CaCl_2$ or $MgCl_2$ are capable of dissolving tightly hydrogen bonded, beta sheet silk fibroin allowing for the direct preparation of regenerated silk fibers without a separate and costly decrystallization step. When $CaCl_2$ is the metal ion salt, the solution is a weight ratio range of formic acid: $CaCl_2$ of 97.5:2.5 to 85:15, preferably 95:5 to 90:10. When $MgCl_2$ is the metal ion salt, the solution is a weight ratio range of formic acid: $MgCl_2$ of 97.5:2.5 to 90:10, preferably 94:6 to 96:4. In addition, the silk fibroin protein is stable to molecular weight loss over several days in these solvent mixtures, as shown in FIG. 2.

The spinning processes employed in the Examples are wet spinning and dry-jet wet spinning, generally described and illustrated in the Kirk-Othmer Encyclopedia of Technology, $4^{th}$ edition, Wiley-Interscience, volume 10 (1993) pages 663–664, and volume 13 (1995) pages 317–318, respectively. In the dry-jet wet spinning method, an air gap exists between the end of the spinneret and the surface of the liquid in the first quench bath. As shown herein, the air gap is 0 to 25.4 mm, preferably 0 to 12.7 mm. This arrangement can be advantageous in that the fiber can be drawn more readily in air than in solution as in wet spinning, resulting in more efficient process conditions and good fiber properties.

The spinnerets used in this process may have any convenient configuration. The holes of the spinneret through which the threadline is extruded may be round or shaped to provide any desired cross-section. Any desired number of holes may be used as limited by the equipment. The preferred range of hole size for the process described herein is 0.1 to 0.5 mm in diameter.

While the addition of common fiber additives in not required, surfactants, antioxidants and other polymers can be added to the spin dope before spinning.

Process of the Invention

A. Scoured Silk

*Bombyx mori* (*B. mori*) silk filature is substantially cleaned of sericin (a water-soluble filament coating protein) by scouring the cocoon fiber in hot soap solution. Fats and waxes are subsequently removed by extracting with hot ethyl alcohol.

B. Decrystallized Silk

The scoured fiber is then dissolved in $LiSCN/H_2O$ (70–45/30–55 w/w) at about 15% by weight, placed into dialysis tubing and dialyzed against water for at least 18 hours to remove the salt. The viscous, highly shear sensitive solution is then freeze dried to yield a decrystallized silk (D-silk) flake that is dissolved and spun according to the examples below.

C. Fiber Spinning

Figure 1:
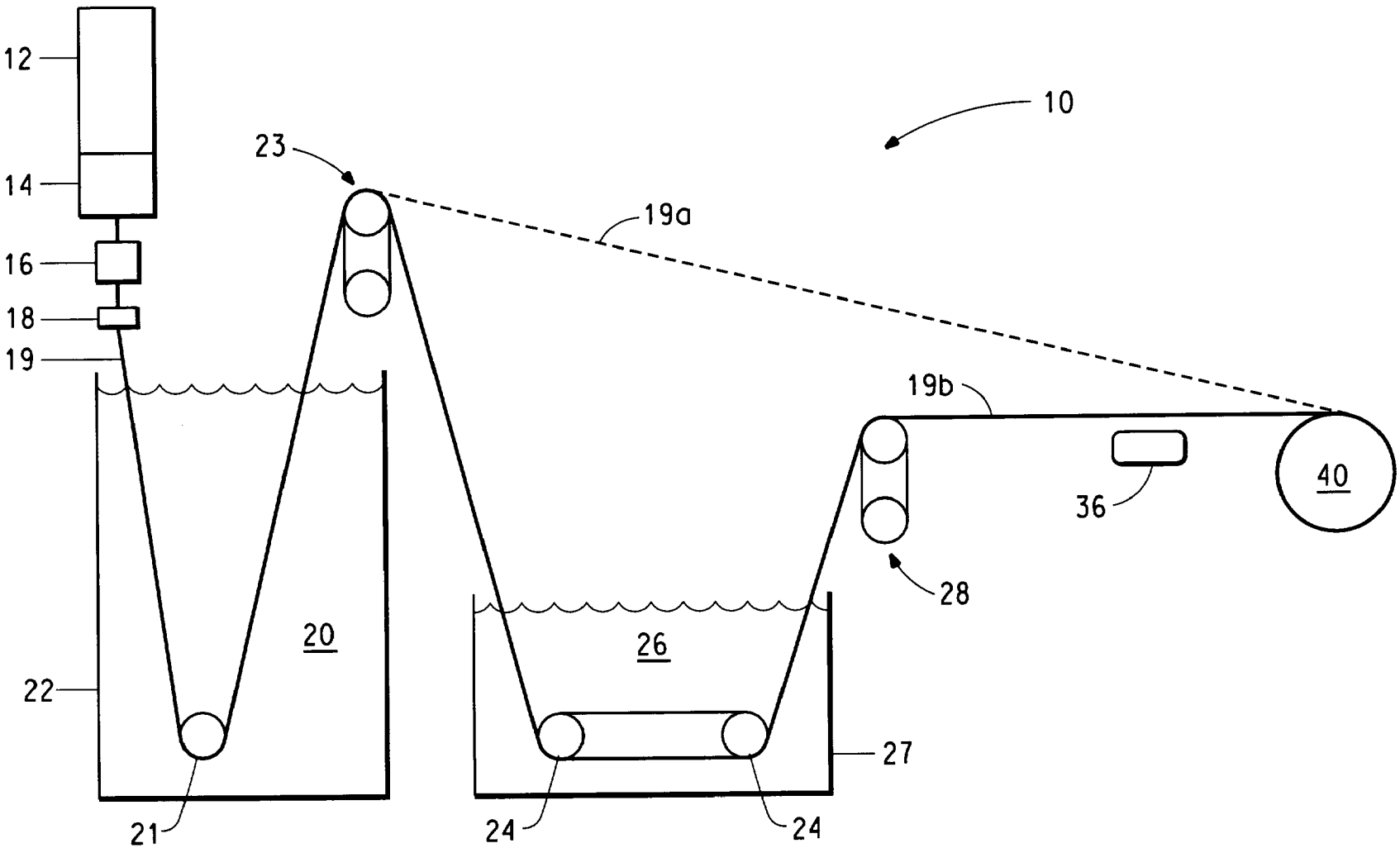
FIG. 1 is a diagram of the apparatus used for the process of the invention.

The process of the instant invention is performed on apparatus 10 as shown in FIG. 1. Spin solution is fed into the system using a metering pump 12, which meters the solution into spin cell 14 through filter 16, and spinneret 18 to produce fiber threadline 19. The threadline enters liquid 20 in a first quench bath, known as the coagulation bath 22. Optionally, the threadline may pass through an air gap prior to entering the coagulation bath. The threadline passes over at least one pin 21 submerged in the liquid of the coagulation bath. The threadline is drawn out of the first coagulation bath by passing over a first set of draw rolls 23. The draw rolls may be driven manually or by a motor. As shown in FIG. 1, threadline 19*a* may, at this point, be wound-up on receiving station, a preferred example of which is a standard wind-up 40.

Optionally, threadline 19 will generally continue into liquid 26 of a second quench bath, known as the draw or wash bath 27, where it will pass over at least one guide pin 24. The threadline then exits the second wash/draw bath. Similarly, threadline 19*b* can be wound-up on the receiving station 40 at this point. The wash/draw baths contain a liquid, which is water, methanol, or a mixture of water and methanol at ratios of 100:0 to 0:100 weight percent. The temperature of this bath is preferably in the range of 25° C. to 95° C.

Optionally, threadline 19 may be directed to make surface contact with a heated surface, preferably a heated metal surface such as a hot shoe, 36 before being wound on the receiving station. The heating is done to enhance molecular orientation by annealing in the direction of draw while the fiber is still in a pliant state.

Additional wash/draw baths may be used as desired to favor the development of various combinations of fiber tenacity, elongation and modulus. In general, hot drawing modules will enhance fiber strength and modulus while reducing the elongation to break. Each bath contains guide pins over which the threadline is directed. Any number of pins may be used, but is generally from one to three.

The fiber threadline is drawn from each bath by at least one driven roll. The draw rolls are motor-driven but may operate manually or by other generally available means. Preferably, the first driven roll pulls the fiber threadline from the coagulation bath at a speed that is comparable to or slower than the jet velocity at the spinneret. When the speed is slower, the extruded fiber is allowed to undergo some shrinkage in the coagulation bath and is particularly advantageous when threadline wet strength is low. The first draw roll is most preferably driven at speeds in the range of 0.90 to 2.45 m/min and the windup is most preferably driven at 5.5 to 56.0 m/min. When the windup turns faster than the first driven roll, drawing of the fiber in the area between the two driven rolls occurs.

Alternatively, it may be desirable to exert some draw on the threadline in the coagulation bath. The determination of the best mode of operation is sensitive to the solution concentration, coagulation bath composition and extrusion rate.

In the preferred embodiment, the temperature of the liquid in the quench baths is independently between −20° C. and 60° C., more preferably being 0° C. and 40° C., and most preferably 15° C. to 35° C. The composition of the coagulation bath liquid is an alcohol or mixtures of alcohol and water, preferably being methanol, ethanol, isopropanol, methanol/water, ethanol/water and isopropanol/water, and most preferably methanol and methanol/water.

After winding, the polypeptide fiber is processed according to the desired end use application. For example, when multi-filament yarns are spun, the fiber is air-dried, finish is applied and the yarn is knitted/woven into hosiery and textile fabrics.

This invention also provides a method for producing regenerated polypeptide fibers, generally comprising the following steps. First the decrystallized polypeptide is dissolved in low water content formic acid, which contains no more than 5 weight percent water, preferably no more than 0.5 weight percent water. The decrystallized polypeptide can be either a natural silk, for example, *Bombyx mori* silk or synthetic silk protein. The solution formed is initially at less than 10% by weight, and is subsequently concentrated to a solution greater than 10% polypeptide, preferably greater than 15%, by weight. The resultant more concentrated solution is then metered through a spinneret into a liquid contained in a coagulation bath, so that one or more fibers are formed. The resulting fibers are then quenched, with a resultant tensile strength of at least 2.5 grams/denier.

An alternative embodiment of the method of this invention is a process for producing regenerated polypeptide fibers comprising the following steps. First the polypeptide is dissolved in a solution comprised of water and lithium thiocyanate (LiSCN) in a weight ratio range of 95:5 to 85:15, preferably in a weight ratio range of 95:5 to 90:10. The polypeptide is present initially at a level of less than 15% by weight, and may be either natural silk or synthetic silk protein, for example. The mixture of the polypeptide and LiSCN is then concentrated so the polypeptide is present at a level of greater than 15%, preferably greater than 17%, by weight, and the LiSCN is present at a level less than 13% preferably less than 12% by weight. This solution is then metered through a spinneret into a liquid contained in a coagulation bath to form one or more fibers. The resulting fibers are subsequently drawn so they have a tensile strength of at least 2.0 grams/denier.

The coagulation bath of the process of the invention is generally contains a liquid comprising water, methanol and/or water/methanol in the range of 0–100/100–0 weight percent.

EXAMPLES

The instant invention is further defined in the following Examples. It should be understood that these Examples, while indicating preferred embodiments of the invention, are given by way of illustration only. From the above discussion and these Examples, one skilled in the art can ascertain the essential characteristics of this invention, and without departing from the spirit and scope thereof, can make various changes and modifications of the invention to adapt it to various uses and conditions.

The general procedures as set forth above were followed using conditions as described. Spinning solutions were examined for fiber forming character, viscosity and optical clarity. If the solution were judged to be acceptable for spinning, it was transferred to a polyethylene syringe fitted with a 10 micron sintered stainless steel filter sealed around the edges with a Teflon® tape gasket. Wet spinning was accomplished with the filter-equipped syringe described above using a syringe pump. FIG. 1 is a schematic of the spinning apparatus and the detailed spinning parameters are given in Table 1.

The length of the quench baths were adjusted by directing the extrudate through multiple passes in the bath around Teflon® guides (E.I. du Pont de Nemours and Company, Wilmington, Del.) or ceramic guides. In general, tensioning guides or draw rolls were used at the positions indicated to isolate that stage of the process from those upstream or downstream. On-line heat treatments were carried out by surface contact with 8.57-cm long hot shoes or by passing through a clamshell type 40 cm long by 2.54-cm ID tube furnace. In some instances, all extrudate spin stretch was accomplished at the wind-up and calculated by dividing the wind-up speed by the extrudate velocity (jet velocity). Temperature control of the coagulation bath was managed using a heat exchange coil immersed in the coagulation bath and connected to a refrigerated/heated constant temperature bath with re-circulating pump.

Spinnerets were fabricated from stainless steel blanks having a single tapered capillary bore having overall length/diameter ratios and hole sizes as shown in Table 1. Otherwise the general procedure consisted of soaking the freshly spun samples while on stainless steel bobbins in jars containing coagulating solvent or water for 2–16 hours and then allowing the samples to dry at room temperature on the bobbins.

Physical properties such as tenacity, elongation and initial modulus were measured using methods and instruments conforming to ASTM standard D 2101-82, except that the test specimen length was 2.54 cm. Mechanical testing results are demonstrated for 2.54-cm filaments and represent the average of three to five individual breaks. Data for natural fiber samples were obtained without any pretreatment.

Example 1

Solution Preparation and Extrusion from 99.6% Formic Acid at 14.2% Solids

D-silk (2 g) was dissolved in formic acid (18 g, 99.6%) to yield a solution of 5% solids. The resulting solution was first filtered through a 325-mesh stainless steel screen and then concentrated to 14.2% solids on a vacuum line by vacuum distillation of formic acid at or below room temperature. Careful stirring was maintained to assure good dope uniformity throughout the concentrating step. The clear, viscous solution was transferred into a 10 cc polyethylene syringe fitted with an 10 um stainless steel filter, a single hole, 0.127 mm diameter×0.254 mm capillary length spinneret. The fiber was wet extruded at 6.4 m/min into a coagulation bath consisting of 75/25-v/v methanol/$H_2O$ at 27° C. The extrudate traversed 45.7 cm in coagulation bath 1 and was subsequently collected on a 3.8-cm diameter stainless steel bobbin at a speed of 55.8 meters per minute. The fiber guides were kept wet with methanol throughout the extrusion and the bobbin was washed continuously with a methanol drip during windup. The bobbin of lustrous, white fiber was soaked in methanol for 16 h and then air dried at ambient temperature. Average 2.54 cm single filament tensile strength was 3.7 grams/denier (g/d)

Example 2

Solution Preparation and Extrusion from Formic Acid/$H_2O$ at 21.0% Solids

D-silk (3 g) was dissolved in formic acid/water (97.5/2.5 W/W, 57 g), filtered through a 325 mesh screen and concentrated under vacuum to 21 percent solids. The resulting solution was transferred into a polyethylene 10 cc syringe fitted with a 10 um filter and the same spinneret as in example 1. The jet velocity was set at 6.4 m/min. The first coagulation bath consisted of a mixture of 50/50 water/methanol maintained at about 21° C. giving a total immersion length of 45.7 cm. The extruded filament then entered a second coagulation bath consisting of a mixture of methanol/water at 35° C. for a total immersion length of 1.3 m. The filament then proceeded into a 46 cm hot water bath maintained at 93–94° C. The resultant filament was wound up at 5.64 m/min. The bobbin of fiber and was then allowed to air dry under ambient conditions and mechanical properties were measured without further treatment. The average filament tensile strength was 2.5 g/d.

Example 3

Solution Preparation and Extrusion from Formic Acid/$H_2O$ at 17.8% Solids

A solution of D-Silk was prepared as described an Example 2 and concentrated from a 5 percent solution by a vacuum distillation to 17.8% solids. Fibers were spun using similar procedures as for Example 2 except that coagulation baths 1 and 2 contained methanol only and a hot shoe at 148° C. was used for additional heat treatment immediately before the windup. Complete details of the spinning process conditions employed are given in Table 1. The average as-spun filament tensile strength was 2.5 g/d.

Example 4

Extrusion of Scoured Silk from Formic Acid/$CaCl_2$ Mixtures (Direct Solution Preparation at High Solids) using Dry-Jet Wet Spinning Scoured silk (2.0 g) was dissolved in a mixture of 99.6% formic acid (5.4 g) and calcium chloride (0.61 g) to yield a solution containing 10 weight % calcium chloride and 25% solids silk. The resulting solution was allowed to stand for 72 hours at room temperature yielding an amber colored, flowable solution. A 10-cc polyethylene syringe fitted with a 10 um filter and a spinneret having a capillary 0.254 mm in diameter by 4.45 mm in length was then charged with the solution. Extrusion (at a jet velocity of 1.52 m/min was conducted across an air gap of 1.3 cm into a coagulation bath containing a 75/25 v/v mixture of methanol/water for a total immersion length of 46 cm in coagulation bath 1. The coagulated fiber was wound onto a driven roll turning at a speed of 1.5 m per minute and kept wet with a methanol drip. From there the fiber was collected on a bobbin turning at 6.7 m per minute. The as spun fiber was soaked in methanol for 16 hours, washed with fresh methanol and allowed to air dry under ambient conditions. As spun tensile strength was 2.7 g/d.

Example 5

Extrusion of Scoured Silk from Formic Acid/$CaCl_2$ (Direct Dissolution in HCOOH/$CaCl_2$ (97.5/2.5 w/w) and Concentration to Higher Solids)

Scoured silk (2.0 g) was dissolved in a mixture of 99.6% formic acid (17.55 g) and calcium chloride (0.45 g) to yield a solution containing 2.3 weight % calcium chloride and 10% solids silk. The solution was further concentrated to 19.6% solids silk by vacuum distillation of formic acid (9.8 g). A 10-cc polyethylene syringe fitted with a 10 um filter and a spinneret having a capillary 0.127 mm in diameter by 0.254 mm in length was then charged with the solution. Extrusion (at a jet velocity of 6.4 m/min) was conducted across an air gap of 0.5 cm into a coagulation bath containing a 75/25 v/v mixture of methanol/water for a total immersion length of 46 cm in coagulation bath 1 at 22° C. The filament exited the coagulation bath onto a driven roll turning at 1.22 m/min which was kept wet with methanol using a methanol drip. Finally the fiber was collected on stainless steel bobbins at a windup speed of 7.92 m/min. Average as spun filament tensile strength was 2.6 g/d.

Example 6

Extrusion of Scoured Silk from Formic Acid/$CaCl_2$ (Direct Dissolution in HCOOH/$CaCl_2$ (97.5/2.5 w/w) and Concentration to Higher Solids)

Scoured silk (2.0 g) was dissolved in a mixture of 99.6% formic acid (17.55 g) and calcium chloride (0.45 g) to yield a solution containing 2.3 weight % calcium chloride and 10% solids silk. The solution was further concentrated to 30.3% solids silk, 6.8% solids $CaCl_2$ by vacuum distillation of formic acid (13.4 g). After 24 h a 10-cc polyethylene syringe fitted with a 10 um filter and a spinneret having a capillary 0.127 mm in diameter by 0.254 mm in length was then charged with the solution. Extrusion (at a jet velocity of 1.5 m/min) was conducted directly into coagulation bath 1 containing methanol at 23° C. for a total immersion length of 46 cm. The filament exited the coagulation bath onto a driven roll turning at 1.37 m/min, which was kept wet with methanol using a methanol drip. From there the fiber was drawn through a water bath (46 cm, 47° C.) and collected on a stainless steel bobbin at 2.1 m/min. Average as spun filament tensile strength was 2.6 g/d.

Example 7

Extrusion of Scoured Silk via Direct Dissolution in $H_2O$/LiSCN and Concentrating to Higher Solids Scoured silk (6.0 g) was dissolved over 96 hours in a mixture of $H_2O$/LiSCN (28.25 g, 55/45 w/w) to yield a solution containing 31 wt % lithium thiocyanate and 17.5 wt % silk. The resulting clear solution was filtered through a 325-mesh stainless steel screen and dialysed and against polyethylene glycol/water over 48 h. (Polyethylene glycol (25 g) was dissolved in deionized water (75 g)). Dialysis was conducted in a closed container using a magnetic stirrer to agitate the aqueous polyethylene glycol solution. The total solids level was calculated to be 26.3%. The highly viscous solution was then transferred into a 10-cc polyethylene syringe fitted with a short length of 1.6 mm stainless steel tubing, which was connected to another 10-cc syringe. The solution was pumped back and forth between the two syringes to achieve a uniformly mixed spin dope. The dope was then transferred into a 10 cc polyethylene syringe fitted with a 10 um filter and a spinneret having a capillary 0.254 mm in diameter by 4.45 mm in length. Extrusion (at a jet velocity of 2.21 m/min) was conducted directly into coagulation bath 1 containing methanol at 16° C. for a total immersion length of 38.1 cm. The filament exited the coagulation bath onto a driven roll turning at 2.0 m/min that was kept wet with methanol/water (75/25-v/v) drip. From there the fiber was collected on a stainless steel bobbin at 2.1 m/min. Average as spun filament tensile strength was 2.0 g/d.

Example 8

Extrusion of Scoured Silk from Formic Acid/$CaCl_2$ (Direct Dissolution in HCOOH/$CaCl_2$ (93.3/6.7 w/w))

Scoured silk (2.0 g) was dissolved in a mixture of 99.6% formic acid (8.50 g) and calcium chloride (0.61 g) to yield a solution containing 5.4 weight % calcium chloride and 18% solids silk. After 24 h a 10-cc polyethylene syringe fitted with a 10 um filter and a spinneret having a capillary 0.127 mm in diameter by 0.254 mm in length was charged with the solution. Extrusion (at a jet velocity of 6.1 m/min) was conducted directly into coagulation bath 1 containing methanol/water (75/25 v/v) at 20° C. for a total immersion length of 46 cm. The filament exited the coagulation bath onto a driven roll turning at 1.5 m/min that was kept wet with methanol using a methanol drip. From there the fiber was drawn through a water/methanol (75/25 v/v) bath (1.4 m, 27° C.), passed over a hot shoe with surface temperature of 138° C. and finally collected on a stainless steel bobbin at 9.45 m/min. Average as spun filament tensile strength was 2.2 g/d.

Example 9

Extrusion of Scoured Silk from Formic Acid/$MgCl_2$ (Direct Dissolution in HCOOH/$MgCl_2$ (94.3/5.7 w/w))

Scoured silk (2.0 g) was dissolved in a mixture of 99.6% formic acid (8.69 g) and magnesium chloride (0.42 g) to yield a solution containing 4.6 weight % magnesium chloride and 18% silk. After 48 h a 10-cc polyethylene syringe fitted with a 10 um filter and a spinneret having a capillary 0.127 mm in diameter by 0.254 mm in length was charged with the solution. Extrusion (at a jet velocity of 6.4 m/min) was conducted directly into coagulation bath 1 containing methanol/water (75/25 v/v) at 25° C. for a total immersion length of 46 cm. The filament exited the coagulation bath onto a driven roll turning at 3.1 m/min which was kept wet with methanol using a methanol drip. From there the fiber was collected on a stainless steel bobbin at 7.93 m/min. Average as spun filament tensile strength was 1.8 g/d.

Comparative Example 1

Extrusion of Scoured Silk from Formic Acid/LiCl (Direct Dissolution in HCOOH/LiCl (90/10 w/w))

Scoured silk (2.0 g) was dissolved in a mixture of 99.6% formic acid and lithium chloride (95/5 w/w, 12 g) to yield a solution containing 14.2% silk. The solution pre-filtered through a 325 mesh stainless steel screen and was then loaded into a 10 cc polyethylene syringe fitted with a 10 um filter and a spinneret having a capillary 0.127 mm in diameter by 0.254 mm in length. Extrusion (at a jet velocity of 6.4 m/min) was conducted directly into coagulation bath 1 containing methanol/water (75/25 v/v) at 29° C. for a total immersion length of 46 cm. The filament exited the coagulation bath and was collected on a stainless steel bobbin at 26.8 m/min. Average as spun filament tensile strength was 0.39 g/d.

Comparative Example 2

Extrusion of D-Silk from Formic Acid/LiCl (Direct Dissolution in HCOOH/LiCl (90/10 w/w)

Scoured silk (2.0 g) was dissolved in a mixture of 99.6% formic acid and lithium chloride (90/10 w/w, 13.2 g) to yield a solution containing 15.2% silk. The solution was loaded into a 10-cc polyethylene syringe fitted with an X5 Dynalloy filter and a spinneret having a capillary 0.127 mm in diameter by 0.254 mm in length. Extrusion (at a jet velocity of 6.4 m/min) was conducted directly into coagulation bath 1 containing methanol/water (75/25 v/v) at 20° C. for a total immersion length of 46 cm. The filament exited the coagulation bath onto a driven roll turning at 2.7 m/min that was kept wet with methanol using a methanol drip. From there the fiber was drawn through a methanol bath (1.4 m, 15° C.) and collected on a stainless steel bobbin at 9.8 m/min. Average as spun filament tensile strength was 1.3 g/d.

TABLE 1

| Ex. No. | Polymer Conc. (%) | Diameter of holes (mm) | Hole L/D | Jet Speed (mpm) | Coag. Bath Length (m) | Coag. Bath Medium | Coag. Bath Temp. (° C.) | 1st Draw Roll Drip | 1st Draw Roll Temp. (° C.) |
|---|---|---|---|---|---|---|---|---|---|
| Natural Fiber | | | | | | | | | |
| Ex. 1 | 14.20 | 0.127 | 2.0 | 7.2 | 0.46 | MeOH/ H2O, 75/25 | 27.0 | | |
| Ex. 2 | 21.00 | 0.127 | 2.0 | 0.0 | 0.46 | MeOH/ H2O, 50/50 | 21.0 | MeOH/ H2O | 35 |
| Ex. 3 | 17.80 | 0.127 | 2.0 | 10.6 | 0.40 | MeOH | 19.0 | MeOH | 2 |
| Ex. 4 | 25.00 | 0.445 | 1.8 | 1.7 | 0.46 | MeOH/ H2O, 75/25 | 21.0 | MeOH | 25 |
| Ex. 5 | 19.60 | 0.127 | 2.0 | 7.2 | 0.46 | MeOH/ H2O, 75/25 | 21.0 | MeOH | 25 |
| Ex. 6 | 30.30 | 0.127 | 2.0 | 1.7 | 0.46 | MeOH | 23.0 | MeOH | 25 |
| Ex. 7 | 17.50 | 0.254 | 17.5 | 3.3 | 0.40 | MeOH | 16.0 | MeOH/ H2O | 25 |
| Ex. 8 | 20.00 | 0.127 | 2.0 | 6.8 | 0.46 | MeOH/ H2O, 75/25 | 20.0 | MeOH | 25 |
| Ex. 9 | 18.00 | 0.127 | 2.0 | 3.5 | 0.46 | MeOH/ H2O, 75/25 | 31.0 | MeOH | 25 |
| Comp. Ex. 1 | 14.20 | 0.127 | 2.0 | 7.1 | 0.46 | MeOH/ H2O, 75/25 | 30.0 | | |
| Comp. Ex. 2 | 15.20 | 0.127 | 2.0 | 7.2 | 0.46 | MeOH/ H2O, 75/25 | 20.0 | | |

| Ex. No. | 1st Draw Roll Speed (mpm) | Wash Bath Medium (v/v) | Wash Bath Length (m) | Wash Bath Temp. (° C.) | Wind-up Speed (mpm) | Mechanical Properties T (gpd) | E (%) | M (gpd) | Denier |
|---|---|---|---|---|---|---|---|---|---|

TABLE 1-continued

| | | | | | | | | | |
|---|---|---|---|---|---|---|---|---|---|
| Natural Fiber | | | | | | 4.04 | 14.59 | 74.1 | 1.2 |
| Ex. 1 | 0.00 | | 0.00 | | 55.78 | 3.69 | 11.41 | 170.9 | 3.4 |
| Ex. 2 | 0.91 | H2O | 0.46 | 93 | 5.64 | 2.49 | 16.74 | 69.3 | 40.6 |
| Ex. 3 | 2.44 | H2O | 0.46 | 80 | 14.02 | 2.48 | 12.75 | 72.9 | 19.0 |
| Ex. 4 | 1.52 | | 0.00 | | 6.71 | 2.74 | 16.33 | 84.7 | 26.2 |
| Ex. 5 | 1.22 | | 0.00 | | 7.92 | 2.57 | 22.72 | 64.2 | 24.8 |
| Ex. 6 | 1.37 | WATER | 0.46 | 47 | 6.40 | 2.57 | 15.87 | 64.9 | 55.2 |
| Ex. 7 | 1.95 | | 0.00 | | 7.92 | 1.97 | 15.47 | 57.0 | 43.9 |
| Ex. 8 | 1.52 | MEOH/ H2O, 1/1 | 1.37 | 27 | 9.45 | 2.18 | 15.60 | 73.1 | 23.3 |
| Ex. 9 | 0.00 | | 0.00 | | 13.11 | 1.79 | 9.87 | 82.0 | 5.6 |
| Comp. Ex. 1 | 0.00 | | 0.00 | | 27.13 | 0.39 | 3.23 | 41.1 | 5.2 |
| Comp. Ex. 2 | 0.00 | | 0.00 | | 9.75 | 1.27 | 25.70 | 51.9 | 17.1 |

What is claimed is:

1. A process for producing regenerated polypeptide fibers, the process comprising the steps of:

(a) providing a decrystallized polypeptide, (b) contacting the decrystallized polypeptide with formic acid containing no more than 3 weight percent water, initially at less than 10 percent polypeptide by weight, (c) concentrating the solution produced in step (b) to greater than 10 percent polypeptide by weight, (d) metering the concentrated solution produced step (c) through a spinneret into a liquid contained in a coagulation bath to form one or more fibers, (e) drawing the fibers, (f) optionally contacting the fibers to a heated surface, and (g) optionally, winding the fibers onto a receiving station.

2. A process for producing polypeptide fibers, the process comprising the steps of:

(a) providing a polypeptide, (b) contacting the polypeptide with water/lithium thiocyanate initially at less than 15 percent polypeptide by weight, (c) concentrating by dialysis the solution produced in step (b) to greater than 15 percent polypeptide by weight by removing from said solution a portion of the water and lithium thiocyanate, (d) metering the concentrated solution produced in step (c) through a spinneret into a liquid contained in a coagulation bath to from one or more fibers, (e) drawing the fiber(s), (f) optionally contacting the fiber(s) to a heated surface, and (g) optionally, winding the fiber(s) onto a receiving station.

3. The process of claim 1 or claim 2 wherein the composition of the liquid in the coagulation bath is comprised of water, methanol or water/methanol in the range of 0–100/100–0 wt/wt.

4. The process of claim 1 or claim 2 wherein the polypeptide is a natural silk or a synthetic silk protein.

5. The process of claim 1 or claim 2 wherein the polypeptide is Bombyx mori silk protein.

6. The process of claim 2 wherein the concentration of the water/lithium thiocyanate is 65–35/35–65 wt/wt.

* * * * *